United States Patent [19]

Mundschenk

[11] Patent Number: 4,478,005

[45] Date of Patent: Oct. 23, 1984

[54] REMOVABLE INTEGRALLY MOLDED CLOSURE

[75] Inventor: Glenn R. Mundschenk, Utica, N.Y.

[73] Assignee: General Electric Company, New York, N.Y.

[21] Appl. No.: 453,062

[22] Filed: Dec. 27, 1982

[51] Int. Cl.[3] ..... E05C 19/02

[52] U.S. Cl. ..... 49/388; 49/394; 49/397; 292/87; 312/327; 312/328

[58] Field of Search ..... 16/380, 386, 387, DIG. 13; 220/307, 337, 338; 312/290, 326, 327, 328; 292/80, 87, 88, 89; 49/397; 403/328

[56] References Cited

U.S. PATENT DOCUMENTS

| | | | |
|---|---|---|---|
| 404,872 | 6/1889 | Scofield | 292/80 X |
| 587,113 | 7/1897 | Belknap | 312/327 X |
| 3,315,796 | 4/1967 | Dreyfuss | 220/338 X |
| 3,984,028 | 10/1976 | Zinnbauer | 220/338 |
| 4,220,253 | 9/1980 | Thomas et al. | 220/338 |
| 4,407,423 | 10/1983 | Walter | 220/307 X |

*Primary Examiner*—William E. Lyddane
*Assistant Examiner*—Joseph Falk
*Attorney, Agent, or Firm*—George R. Powers

[57] ABSTRACT

A substantially planar closure for a cabinet compartment is disclosed having two resiliently retractable pivot hinges disposed in cantilivered fashion approximately co-axial with the rear edge of the door. This closure can be deployed in a housing opening having a cross-sectional area approximately equal to the planar dimension of the door. A front edge of the door includes an integral retractable latch which can lockingly engage a catch receiving recess disposed on the housing. The latch mechanism is co-axial with the forward edge of the door. A support means integrally formed with the undersurface of the door, provides the rear portion of the closure panel with additional support.

4 Claims, 4 Drawing Figures

REMOVABLE INTEGRALLY MOLDED CLOSURE

FIELD OF THE INVENTION

This invention relates generally to closures for housing openings and more particularly to a substantially planar closure for covering a housing opening in a space efficient manner. Moreover, the present invention provides a unitary closure having all members integrally molded therewith.

BACKGROUND OF THE INVENTION

U.S. Pat. No. 2,765,949 discloses a container and a container lid having a pair of downwardly projecting beaded hinge supports and a downwardly projecting catch. The container side walls include cutouts for receiving the beaded hinges and the container rear wall includes a pair of cutouts for accommodating the hinge supports during operation.

U.S. Pat. No. 3,732,999 relates to a bottle having an integrally formed storage compartment provided in its side wall. A hinge cover is provided for the storage compartment having a pair of non-retractable pintles. The compartment housing includes a pair of cutouts for receiving these pintles. The cutouts are covered by a pair of retaining ledges which bend inwardly and then recoil as the pintle is snapped into place.

U.S. Pat. No. 4,220,253 relates to a three dimensional cover member having a pair of co-axial axially spaced and oppositely outwardly extending rod-like pins or pintle members disposed on the lower edge of its side walls. The side walls are separated from the end walls by a pair of U-shaped notches. This three dimensional cover or lid member is usable only in combination with a housing member having no rear surface in the proximity of the cover or lid member. The cover or lid member can then be moved through the plane of the housing rear surface during an opening operation.

Each of the above discussed patents, illustrates a closure design which requires a housing to be specially configured to accommodate the closure in an operable manner.

The present invention, in contrast, provides a closure member which makes only limited demands upon the housing configuration and is operable within the confines of the housing while still providing the user with easy access to the housing interior. More particularly, a closure in accordance with the present invention comprises a substantially planar panel for covering a housing opening and includes front and rear edges and top, under, first and second side surfaces. A cutout is provided at each intersection of the rear edge and a first or second side surface. A pair of co-axial axially spaced and oppositely outwardly extending rod-like pintle members are disposed on opposite side surfaces. The slit or cutout at the intersection of the first and second side surfaces in the rear edge permits the pintle carrying side surface to retract to permit the pintles to be inserted within a pair of cooperatively disposed co-axial, axially spaced pintle receiving bores disposed in opposite side walls of a cabinet housing. The slits or cutouts are coplanar with the plane of the panel. In a preferred embodiment, the closure includes a substantially rigid support means disposed on the underside of said panel and being approximately perpendicular thereto. The support means can advantageously engage a control panel surface disposed within said housing opening for providing a rear support for said closure panel.

In a preferred embodiment, the closure further includes a latch means integral with and disposed on the front portion of the closure panel. A cutout having a lateral extent in excess of that occupied by said latch means is disposed immediately posterior to the latch means. The latch means can advantageously include a catch means disposed in the undersurface of the front portion of the panel and can advantageously project forward thereof for lockingly engaging at least a portion of said housing. The latch means can advantageously further include a release means integral with the front portion of said panel for retracting said catch mechanism. The release means can advantageously project upwardly from the front edge of said panel. The cutout posteriorily disposed to said latch mechanism permits a force posteriorly directed and applied to the release mechanism to retract the catch in a posterior direction to disengage the closure from the housing.

In a preferred embodiment, the closure of the present invention can be used to enclose a control panel of an audio device such as a table and clock radio. In accordance with the present invention, closures only a minimum portion of the cross-sectional area of the housing opening with the majority of this area be available to provide access to the control switches or buttons deployed in relation therein. Moreover, in a preferred embodiment the bottom surface of the housing is a control panel in which one or more the buttons and switches can be movably mounted. It is preferred that the control panel be mounted within the housing and recessed only a minimum distance from the top planar surface of said housing to permit fingertip access through the closure to the interiorly disposed controls.

Accordingly, the present invention provides a table and clock radio control button housing with a closure which can be removably secured to the housing by a pair of resiliently retractable pintles and employs an integrally molded latch mechanism. The closure additionally provides a uniform appearance in combination with the exterior surface of the housing.

Further objects and features and a more complete understanding of the present invention which may admit to a number of possible variations will be seen from the following detailed description which taken in conjunction with the attached drawings represent the preferred embodiments of this invention.

BRIEF DESCRIPTION OF THE DRAWING

The inventive idea disclosed herein is capable of receiving a variety of mechanical expressions, the accompanying drawings are included for the purpose of illustrating the particular embodiments of this inventive idea and are not intended to be limiting on a scope thereof. In these drawings.

DETAILED DESCRIPTION OF THE PREFERRED EMBODIMENT

Figure 1:
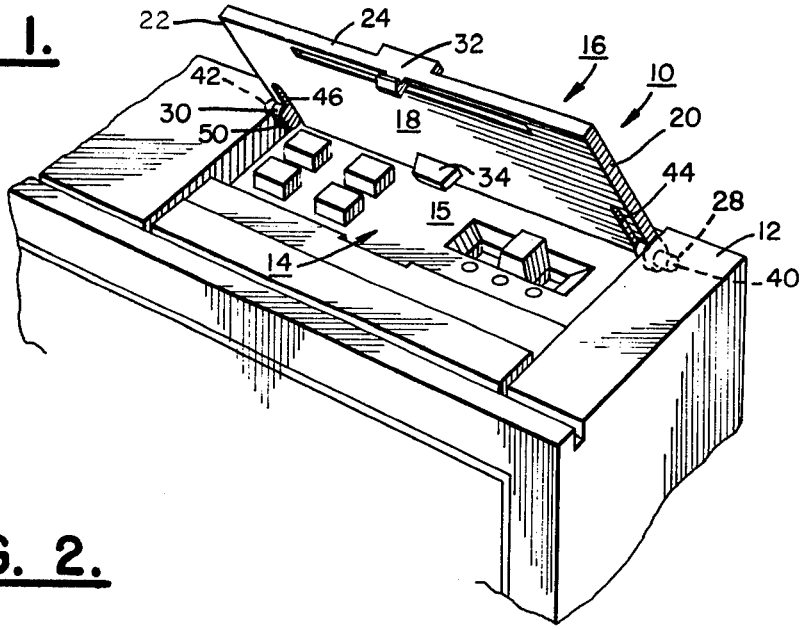
FIG. 1 is an illustration of a space efficient closure in accordance with the present invention disposed within a control button housing.

Referring now to FIG. 1, a removable closure generally designated 10 in accordance with a preferred embodiment of this invention is illustrated hingedly disposed within a cabinet housing 12 for interiorily enclosing a plurality of control buttons or switches 14 disposed within a control panel 15. The closure generally includes a top side surface 16, an underside surface 18, a first side surface 20, a second side surface 22, a front edge surface 24 and a rear edge surface 26.

The closure 10 is substantially planar and is of a unitary construction having first and second hinge mechanism 28 and 30 respectively; a latch mechanism 32 and a support means 34 integrally formed therewith.

The first and second hinge mechanisms 28 and 30 permit the closure 10 to be pivotally mounted within the housing 12 in a space efficient manner to permit the closure to be opened to expose the interiorily disposed controls and afford maximum access thereto. The latch mechanism 32 permits the closure to lockingly engage the housing. The support means 34 can support the rear portion of the closure permit the below described hinge pintles to be disposed in cantilevered fashion, to present a substantially uniform exterior appearance and provide at least a minimum resistance to a force exerted on the exterior surface of the closure 10.

Figure 2:
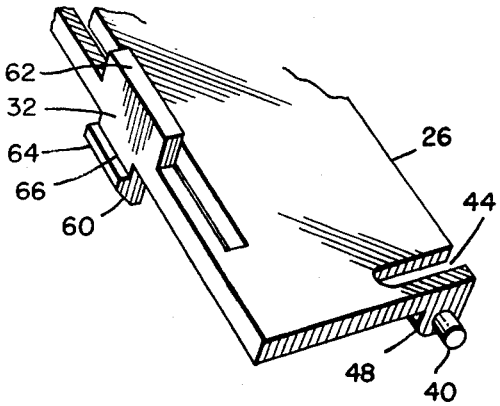
FIG. 2 is a perspective illustration of a closure in accordance with the present invention.

As shown in FIGS. 1 and 2, mechanisms 28 and 30 generally comprise a pair of co-axial, axially space pintles 40 and 42 respectively are disposed on opposite closure side surfaces 20 and 22 proximate the rear edge 26 and extend oppositely outwardly from these side surfaces. A pair of slits or cutouts 44 and 46 are provided in the closure panel 10 proximate the intersection of the first and second side walls 20 and 22 and the rear edge surface 26. These cutouts or slits 44 and 46 permit the pintles supporting portion of the side walls 20 and 22 to retract in the plane of the closure panel under an applied force to permit the closure 10 to be removably inserted with a close fitting closure opening provided by the housing 12. The cutouts or slits are substantially parallel with the side surfaces and extend from the rear edge 26 to approximately the mid-line of the closure 10. In a preferred embodiment the slit is 13.5 mm in length and 1.5 mm wide.

In a preferred embodiment, the closure side surfaces 20 and 22 proximate the rear edge include a pair of ears or flat rigid projections 48 and 50 integrally formed with the side surfaces 20 and 22 and projecting downwardly therefrom. It is further preferred that the outermost edge of these ears 48 and 50 project more than 2.5 mm below the underside surface 18 of the closure 10. Moreover, the pintles, 40 and 42 can advantageously be formed integral with these ears 48 and 50 such that the uppermost surfaces 52 and 54 of the pintles 40 and 42 are substantially co-planar with the underside surface 18 of the closure 10.

Figure 4:
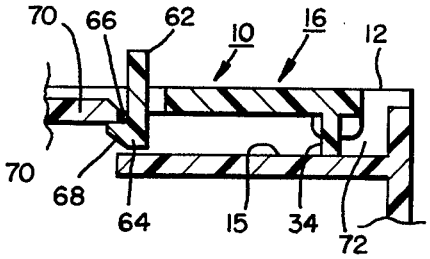
FIG. 4 is a cross-sectional view of the closure positioned within a control compartment housing in latched position.
Figure 3:
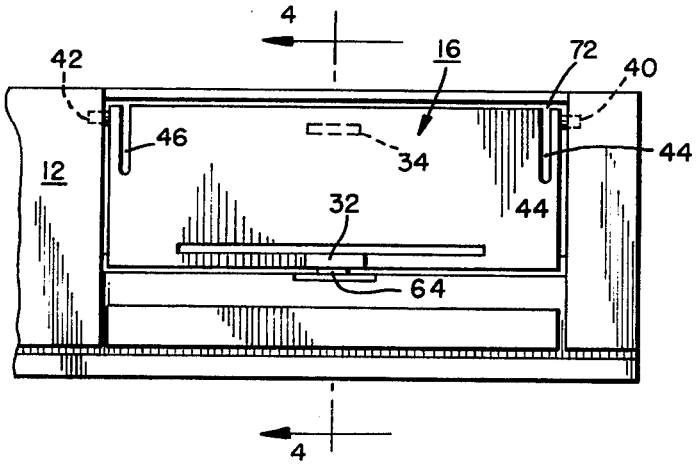
FIG. 3 is a top view of a closure in accordance with the present invention disposed within a control compartment housing in latched position.

The latch mechanism 32, illustrated in more detail in FIGS. 2 and 4, generally comprises a catch mechanism 60 and a release means 62. The latch mechanism can advantageously be integrally molded with the front edge 24 of the closure 10 with the catch and release mechanisms 60 and 62 being substantially co-planar with each other and the front edge 24 and each extending oppositely outwardly from the front edge 24.

More particularly the catch mechanism 60 includes a forwardly extending projection 64 having a substantial flat planar upper surface 66 and a beveled front surface 68. In the engaged position, illustrated in FIG. 4, the planar upper surface 66 of the catch 60 engages a mating planar undersurface of a ledge 70 disposed interior the housing 12 and opposite the catch mechanism 60. The beveled front surface 68 of the catch 60 develops a horizontal force component to an otherwise vertically downwardly directed force to, as will be explained below, retract the resilient catch 60 to permit closure 10 to be closed over the housing opening and be subsequently locked by the catch 68.

The release mechanism 62 shown in FIGS. 2 and 4 generally comprises a member integrally molded with the front edge 24 of the closure and extending vertically outward therefrom. A third cutout is disposed in the closure panel 10 and immediately posterior to the release mechanism 62. This cutout in a preferred embodiment is approximately three times the width of the latch mechanism 32 in width and has a depth approximately equal to the depth of the latch mechanism. This cutout thus permits the latch mechanism 32 to be retracted into the cutout to either engage or disengage the latch mechanism. More particularly, an inwardly directed force applied to the release mechanism 62 causes the catch 60 to become disengaged from the housing ledge 70 and permits the user to subsequently pivot the closure about its pintle hinges 40 and 42 to open the compartment.

It is preferred that the closure of the present invention be molded from a solid but resilient material such as polystyrene plastic. Such material permits the latch bearing from edge 24 and the pintle bearing side surfaces 20 and 22 to retract to engage/disengage the latch or removably position the closure door within the housing. When the closure door is positioned within the housing, the closure pintles 40 and 42 are fixedly positioned within a pair of co-axial, axially spaced bores in opposite side walls of the housing. The closure bearing pintle side walls 20 and 22 retract to enable the pintles 40 and 42 to be inserted within or removed from these axial borings in the housing side wall.

In a preferred embodiment, the closure 10 can advantageously include a support means 34 to provide added support to the closure 10 and particularly the rear portion thereof when it is in its closed position. The support means 34 can advantageously be a substantially rectangular solid having a flat bottom surface, parallel front and rear surfaces and beveled side surfaces. In a preferred embodiment the support means is 3.0 mm thick and 12.0 mm wide. The support means 34 can advantageously be integrally molded with the closure 10 and extend downwardly from the underside 18 thereof. It is preferred that the support be positioned substantially parallel the axis through the pintles 40 and 42 and that the support be positioned proximate the rear edge 26 of the closure 10 and midway between the side surfaces 20 and 22. The support means 34 disposed as described can advantageously provide support for the rear edge 26 of the closure 10 which, otherwise is supported only by the pintles 40 and 42 through the mid-portion of the closure. It is preferred that the support means 34 have a vertical height approximately equal to the depth of the housing opening from the housing exterior surface 12 to the surface of the control panel 15 less the thickness of the closure 10. In a typical example, the depth of the housing opening is approximately 1 cm and the thickness of the closure is approximately 3 mm. Accordingly, the height of the support means is approximately 7 mm.

The aforedescribed removable closure 10 can advantageously be employed to cover a housing opening within tight spatial restrictions. More particularly, the pintles 40 and 42 are disposed substantially co-axial with the rear edge 26 of the closure 10, and thus only a minimum pivot area 72 of FIG. 4 is required between the rear edge 26 of the closure 10 and the abutting edge of the housing. Moreover, the pintles 40 and 42 outwardly extend from retractable side surfaces 20 and 22 of the substantially planar closure 10 to permit the closure 10 to be removably inserted within the housing 12.

Although the invention has been described in its preferred form with a certain degree of particularity, it is understood that the present disclosure of the preferred embodiment is made by way of example and the modifications in the details of construction may be resorted to without departing from the true spirit and scope of this invention. It is intended that the patent shall cover, by suitable expression of the appended claims, whatever features and patentable novelty exists in the invention disclosed.

The invention is claimed as follows:

1. A closure for an opening in a cabinet, said closure comprising:

a substantially planar panel having front, rear, and first and second side edges for closely conforming to the configuration of the opening in the cabinet, a pair of co-axial pintles extending outwardly from the respective ones of said side edges adjacent the rear edge thereof, a pair of cutouts each disposed adjacent and parallel to a respective one of said side edges, each of said cutouts intersecting said rear edge and extending a substantial distance beyond said respective pintle toward said front edge such that said respective pintle projects from a resilient finger formed between said cutout and said respective side edge, whereby said pintles may be resiliently biased toward each other to permit placement of said enclosure in the opening in the cabinet and subsequently move resiliently outwardly to engage bores provided in the cabinet, latch means integral with and disposed on said front edge, and a cutout within said planar panel disposed adjacent and parallel to said front edge and extending a substantial distance beyond said latch means toward each of said side edges such that said latch means is provided on a relatively thin resilient strip extending along the front of said panel, whereby said latch means may be resiliently biased toward said rear edge to permit said front edge of said closure to enter the opening in the cabinet and subsequently move resiliently forward to lock said closure in the opening.

2. The combination as defined by claim 1 wherein a support means extends downwardly from the undersurface of said panel adjacent the control portion of said rear edge.

3. The combination as defined by claim 1 wherein said pintles are separately disposed on a pair of downwardly articulated ears integrally molded with said opposite side surfaces of said closure panel proximate the intersection of said side and rear panels.

4. The combination as defined by claim 3 wherein said upper surfaces of said pintles are substantially coplanar with the underside of said closure.

* * * * *